US011328853B2

(12) United States Patent
Miyauchi et al.

(10) Patent No.: US 11,328,853 B2
(45) Date of Patent: May 10, 2022

(54) REACTOR

(71) Applicant: TOYOTA JIDOSHA KABUSHIKI KAISHA, Toyota (JP)

(72) Inventors: Hiroyuki Miyauchi, Toyota (JP); Hirotaka Kamijo, Aichi-gun (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 749 days.

(21) Appl. No.: 16/207,321

(22) Filed: Dec. 3, 2018

(65) Prior Publication Data

US 2019/0198222 A1 Jun. 27, 2019

(30) Foreign Application Priority Data

Dec. 25, 2017 (JP) ..... JP2017-248183

(51) Int. Cl.

| | |
|---|---|
| ***H01F 27/26*** | (2006.01) |
| ***H01F 27/02*** | (2006.01) |
| ***H01F 27/32*** | (2006.01) |
| ***H01F 27/28*** | (2006.01) |
| ***H01F 27/245*** | (2006.01) |
| ***H01F 37/00*** | (2006.01) |
| *H01F 41/02* | (2006.01) |

(52) U.S. Cl.

CPC ..... *H01F 27/266* (2013.01); *H01F 27/02* (2013.01); *H01F 27/245* (2013.01); *H01F 27/2823* (2013.01); *H01F 27/325* (2013.01); *H01F 37/00* (2013.01); *H01F 41/0233* (2013.01)

(58) Field of Classification Search

CPC ..... H01F 27/266; H01F 27/02; H01F 27/325

See application file for complete search history.

(56) References Cited

U.S. PATENT DOCUMENTS

| | | | | |
|---|---|---|---|---|
| 6,154,113 | A * | 11/2000 | Murai | H01F 27/2828 336/192 |
| 6,611,189 | B2 * | 8/2003 | Sigl | H01F 27/325 336/192 |
| 9,799,442 | B1 * | 10/2017 | Folker | H01F 41/0206 |
| 9,991,045 | B1 * | 6/2018 | Folker | H01F 41/0206 |
| 10,943,724 | B1 * | 3/2021 | Folker | H01F 27/263 |
| 2003/0080844 | A1 * | 5/2003 | Nishikawa | H01F 27/306 336/178 |
| 2004/0036568 | A1 * | 2/2004 | Suzuki | H01F 27/325 336/192 |

(Continued)

FOREIGN PATENT DOCUMENTS

| | | |
|---|---|---|
| JP | 2003-224012 A | 8/2003 |
| JP | 2016-082047 A | 5/2016 |

*Primary Examiner* — Elvin G Enad
*Assistant Examiner* — Malcolm Barnes
(74) *Attorney, Agent, or Firm* — Oliff PLC

(57) ABSTRACT

A reactor includes a bobbin around which a coil is wound, and a core extending through the bobbin. The bobbin has a tubular shape. The core has a quadrangular prism shape. The core includes a distal end surface and a pair of side surfaces perpendicular to the distal end surface. The side surfaces are opposite surfaces of the core. The bobbin includes projections respectively provided on inner surfaces of the bobbin. The inner surfaces of the bobbin respectively face the side surfaces of the core. The projections extend in an axial direction of a tubular portion of the bobbin. The projections are in contact with the core.

4 Claims, 10 Drawing Sheets

(56) References Cited

U.S. PATENT DOCUMENTS

| | | | | |
|---|---|---|---|---|
| 2004/0075524 | A1* | 4/2004 | Nagai | H01F 27/325<br>336/208 |
| 2016/0189862 | A1* | 6/2016 | Miyauchi | H01F 41/005<br>29/606 |
| 2017/0025211 | A1* | 1/2017 | Buhler | H01F 5/02 |

* cited by examiner

REACTOR

INCORPORATION BY REFERENCE

The disclosure of Japanese Patent Application No. 2017-248183 filed on Dec. 25, 2017 including the specification, drawings and abstract is incorporated herein by reference in its entirety.

BACKGROUND

1. Technical Field

The disclosure relates to a reactor. A reactor is a passive element including a coil, and is called "inductor" in some cases.

2. Description of Related Art

A reactor includes a bobbin having a tubular shape, a coil wound around the bobbin, and a core extending through the bobbin. An example of such a reactor is described in Japanese Unexamined Patent Application Publication No. 2016-082047 (JP 2016-082047 A).

SUMMARY

When an angular boundary lies between a distal end surface of a core and a side surface thereof, an edge (i.e., the boundary between the distal end surface and the side surface) of the core may come into contact with a bobbin during insertion of the core into the bobbin, and the edge may be chipped. Typically, when a core is punched out of a magnetic green-compact sintered block, a distal end surface of the core and a side surface thereof become perpendicular to each other, so that an edge is formed at the boundary between the distal end surface and the side surface. A core made through green-compact sintering may be easily chipped, and an edge of the core may be especially easily chipped. The disclosure provides a reactor configured to restrain an edge of a core from being chipped during insertion of the core into a bobbin.

A reactor according to an aspect of the disclosure includes a bobbin around which a coil is wound, and a core extending through the bobbin. The bobbin has a tubular shape. The core has a quadrangular prism shape. The core includes a distal end surface and a pair of side surfaces perpendicular to the distal end surface. The side surfaces are opposite surfaces of the core. The bobbin includes projections respectively provided on inner surfaces of the bobbin. The inner surfaces of the bobbin respectively face the side surfaces of the core. The projections extend in an axial direction of a tubular portion of the bobbin. The projections are in contact with the core. In the reactor, the projections are in contact with the core, and the inner surfaces of the bobbin, which respectively face the side surfaces of the core, are out of contact with the core, except the projections. Thus, edges (i.e., boundaries between the distal end surface and the side surfaces) of the core are less likely to come into contact with the inner surfaces of the bobbin, so that the edges of the core are less likely to be chipped. Note that, only a part of the core to be inserted into the bobbin needs to be in a quadrangular prism shape.

In the above aspect, a height of each of the projections may decrease in a direction toward an opening of the tubular portion. In the vicinity of the opening of the tubular portion of the bobbin, a clearance is left between the core and each projection. Thus, the core can be smoothly inserted into the bobbin.

In the above aspect, the core may include at least two core parts that are a first core part and a second core part, a distal end of the first core part and a distal end of the second core part may face each other inside the bobbin, and the bobbin may include the projections for each of the first core part and the second core part.

The details of the technique described in the present specification and further improvements thereof will be described in "DETAILED DESCRIPTION OF EMBODIMENTS".

BRIEF DESCRIPTION OF THE DRAWINGS

Features, advantages, and technical and industrial significance of exemplary embodiments of the disclosure will be described below with reference to the accompanying drawings, in which like reference signs denote like elements, and wherein.

DETAILED DESCRIPTION OF EMBODIMENTS

Figure 1:
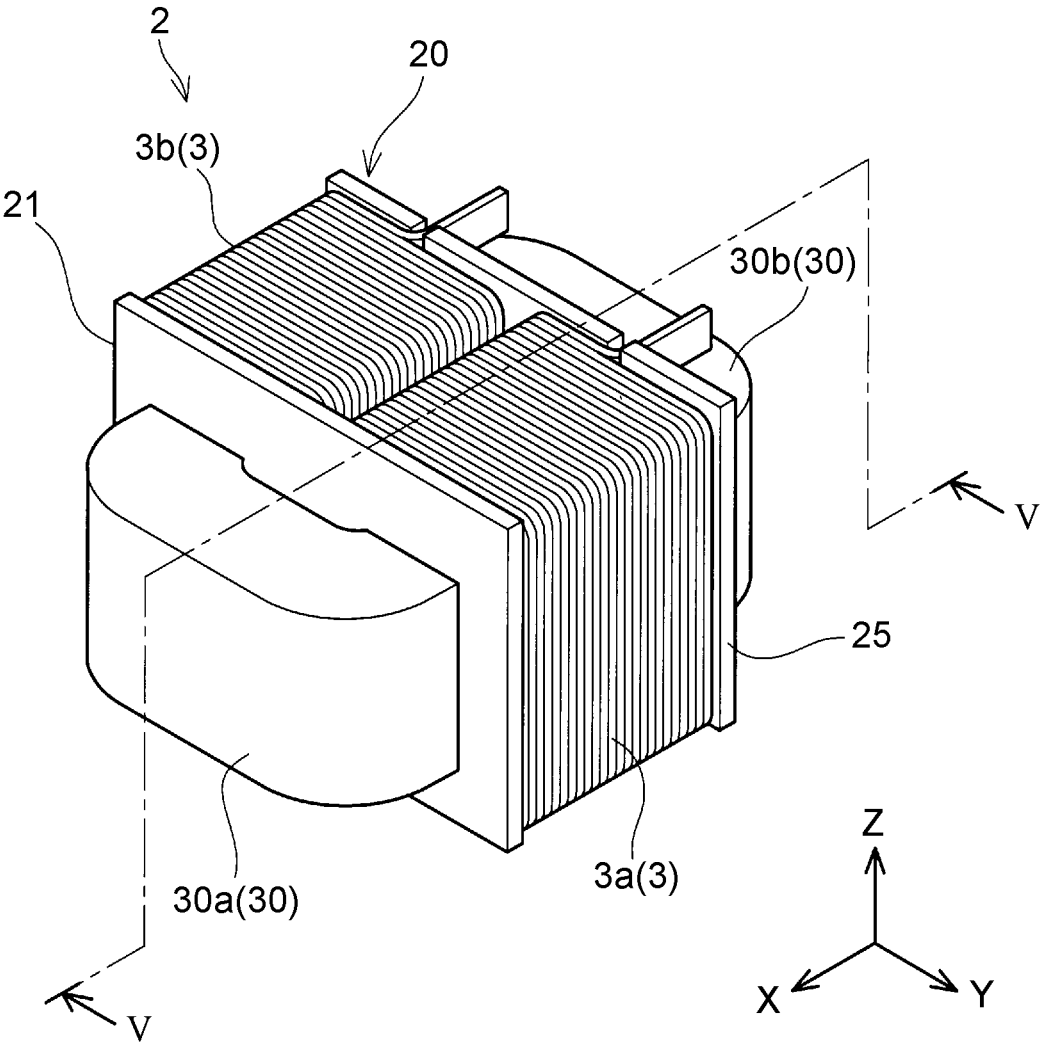
FIG. 1 is a perspective view of a reactor according to an embodiment.

Hereinafter, a reactor 2 according to an embodiment will be described with reference to the accompanying drawings. FIG. 1 is a perspective view of the reactor 2. The reactor 2 is used in a voltage converter configured to boost the voltage of a battery in a drive-train of, for example, an electric vehicle. A traction motor of an electric vehicle is able to output motive power of several tens of kilowatts, and an electric current of several tens of amperes flows out of the battery. Such a high electric current flows through the reactor 2, and thus a flat rectangular wire having a low internal resistance is used as a winding wire. In the following description, for the sake of convenience, the positive direction along the Z-axis in the coordinate system illustrated in the drawings will be defined as "upward" direction, and the negative direction along the Z-axis therein will be defined as "downward" direction.

In the reactor 2, a core 30, which is a magnetic body, extends through a bobbin 20 made of resin, and coils 3*a*, 3*b* are attached to the bobbin 20. Each of the coils 3*a*, 3*b* is an edgewise coil made of a flat rectangular wire. In some cases, the coils 3*a*, 3*b* and the core 30 are covered with a resin cover. However, the resin cover will not be described in the present embodiment.

Figure 2:
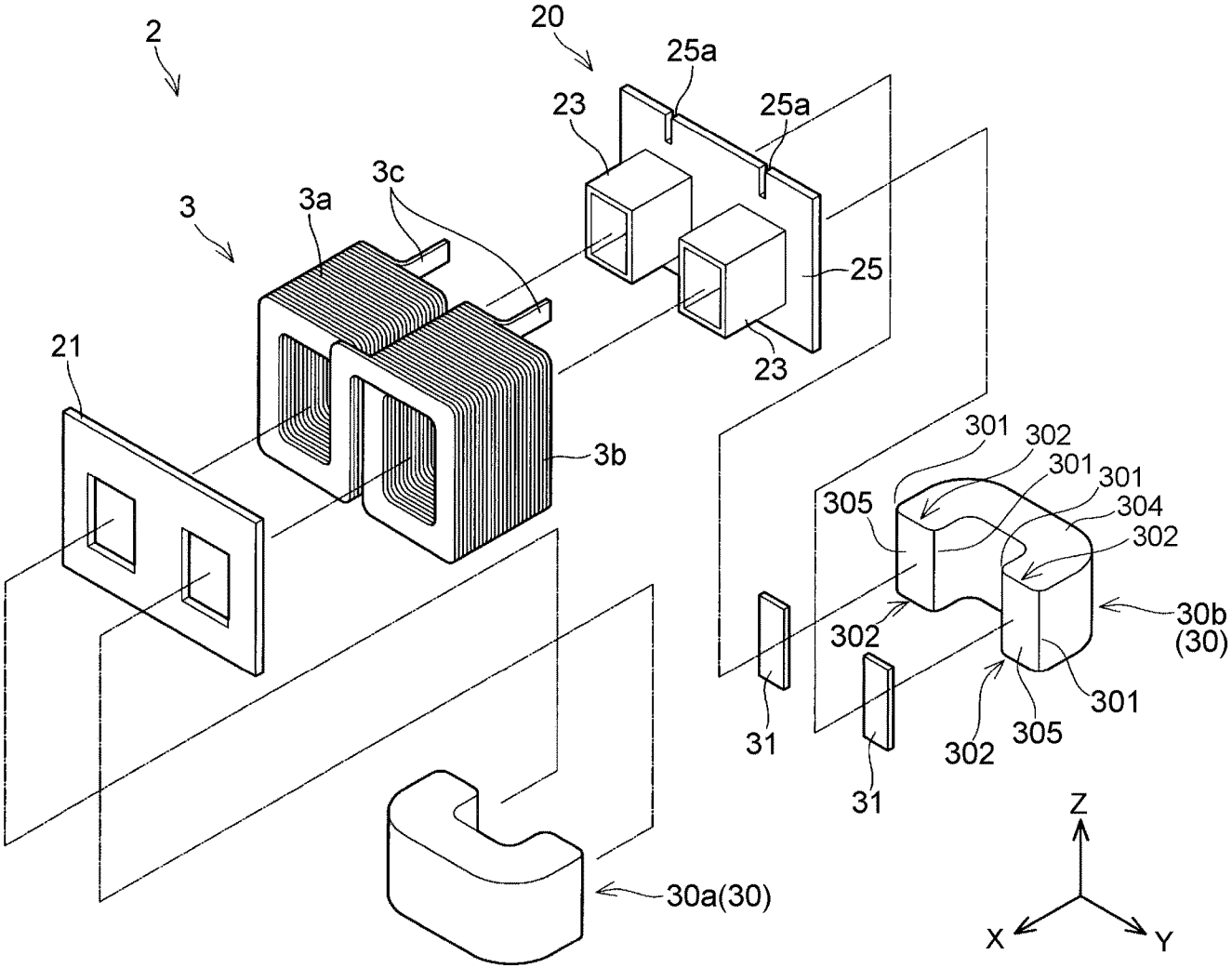
FIG. 2 is an exploded perspective view of the reactor.

FIG. 2 is an exploded perspective view of the reactor 2. The core includes a pair of core parts 30*a*, 30*b* having a U-shape. The core parts 30*a*, 30*b* are disposed so as to face each other, so that a core having a loop shape is provided. The core parts 30*a*, 30*b* having a U-shape will be collectively referred to as "core 30".

The core part 30*b* is produced in the following manner: magnetic particles and resin are mixed together, the mixture is subjected to compression-sintering to form a magnetic green-compact block, and then the core part 30*b* is punched out of the magnetic green-compact block. A punch block is pushed against a surface of the magnetic green-compact block. The surface of the magnetic green-compact block against which the punch block is pushed corresponds to an upper side surface 304 of the core part 30*b*. Note that the upper side surface 304 is an example of "side surface". The magnetic green-compact block is punched into a shape of the core part 30*b*. Hence, distal end surfaces 305 and the upper side surface 304 meet at a right angle, and the distal end surfaces 305 and a lower side surface 309 also meet at a right angle. Note that the lower side surface 309 is an example of "side surface". Thus, edges 302 are formed at the boundaries between the distal end surfaces 305 and the upper side surface 304, and edges 302 are also formed at the boundaries between the distal end surfaces 305 and the lower side surface 309. The boundaries between the distal end surfaces 305 and lateral surfaces are curved surfaces 301. Note that illustrations of reference signs for various portions of the core part 30*a* are omitted. The core part 30*a* is produced in the same manner as that for the core part 30*b*, so that edges 302 are formed at the boundaries between distal end surfaces 305 and an upper side surface 304 and edges 302 are also formed at the boundaries between the distal end surfaces 305 and a lower side surface 309.

The coils 3*a*, 3*b* are formed by winding a single flat rectangular wire, and are configured electrically as a single coil 3. Hereinafter, the coils 3*a*, 3*b* will be collectively referred to as "coil 3" where appropriate.

The bobbin 20 includes a pair of tubular portions 23 having a quadrangular tubular shape, and a pair of flanges 21, 25. The tubular portions 23 and the flanges 21, 25 are all made of resin. The tubular portions 23 are integral with the flange 25. The tubular portions 23 are coupled to the flange 25 such that the tubular portions 23 are parallel to each other. The flange 25 is provided with slits 25*a* through which leads 3*c* of the coil 3 are to be passed. After the coils 3*a*, 3*b* are placed around the tubular portions 23, the flange 21 is coupled to distal ends of the tubular portions 23.

Leg portions of the core part 30*a* having a U-shape are respectively inserted into the tubular portions 23 of the bobbin 20 from the flange 21-side. After spacers 31 are respectively inserted into the tubular portions 23 from the flange 25-side, leg portions of the core part 30*b* having a U-shape are respectively inserted into the tubular portions 23 of the bobbin 20 from the flange 25-side. Inside the tubular portions 23, the distal end surfaces 305 of the core part 30*a* face the distal end surfaces 305 of the core part 30*b* with the spacers 31 interposed therebetween. The shape of a portion of the core 30 disposed inside each tubular portion 23 of the bobbin 20 is a quadrangular prism shape.

Figure 3:
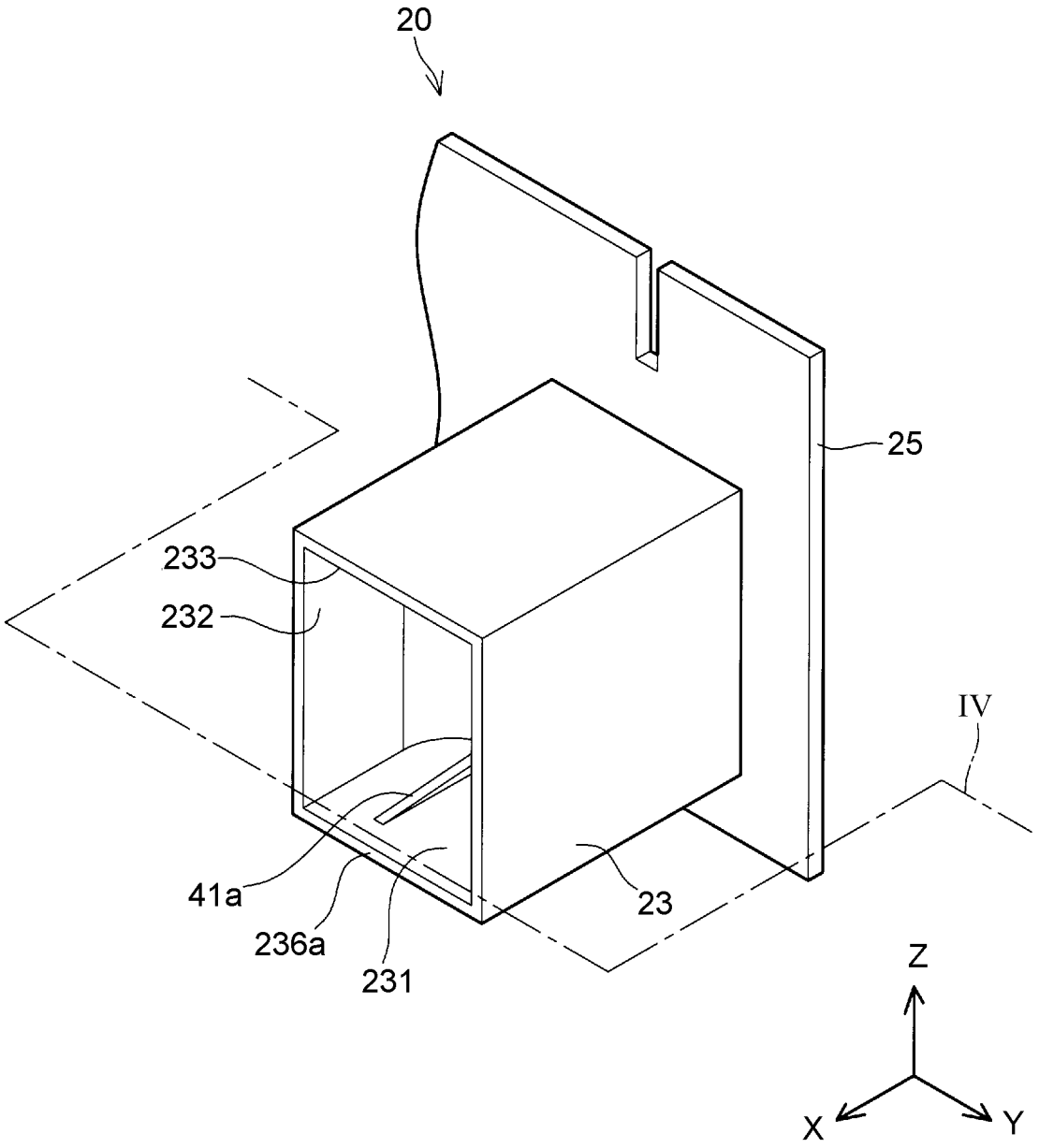
FIG. 3 is an enlarged perspective view of a part of a bobbin.

FIG. 3 is an enlarged perspective view of a part of the bobbin 20. FIG. 3 is a perspective view of the tubular portion 23 coupled to the flange 25. FIG. 3 illustrates the bobbin 20 to which the flange 21 illustrated in FIG. 2 has not yet been attached. The X-direction in the drawings corresponds to the axial direction of each tubular portion 23.

A projection 41*a* is provided on a bottom surface 231 of the tubular portion 23, which is an inner surface of the tubular portion 23. The projection 41*a* extends along the axis (X-direction) of the tubular portion 23. The height of the projection 41*a* decreases in a direction toward an opening 236*a* of the tubular portion 23. Although being hidden and thus not illustrated in FIG. 3, a projection 41*a* having the same shape as that provided on the bottom surface 231 is provided on an upper surface 233 of the tubular portion 23, which is an inner surface of the tubular portion 23. Each lateral surface 232 of the tubular portion 23, which is an inner surface of the tubular portion 23, is curved such that a center portion thereof in the axial direction of the tubular portion 23 protrudes toward the other lateral surface 232.

Figure 4:
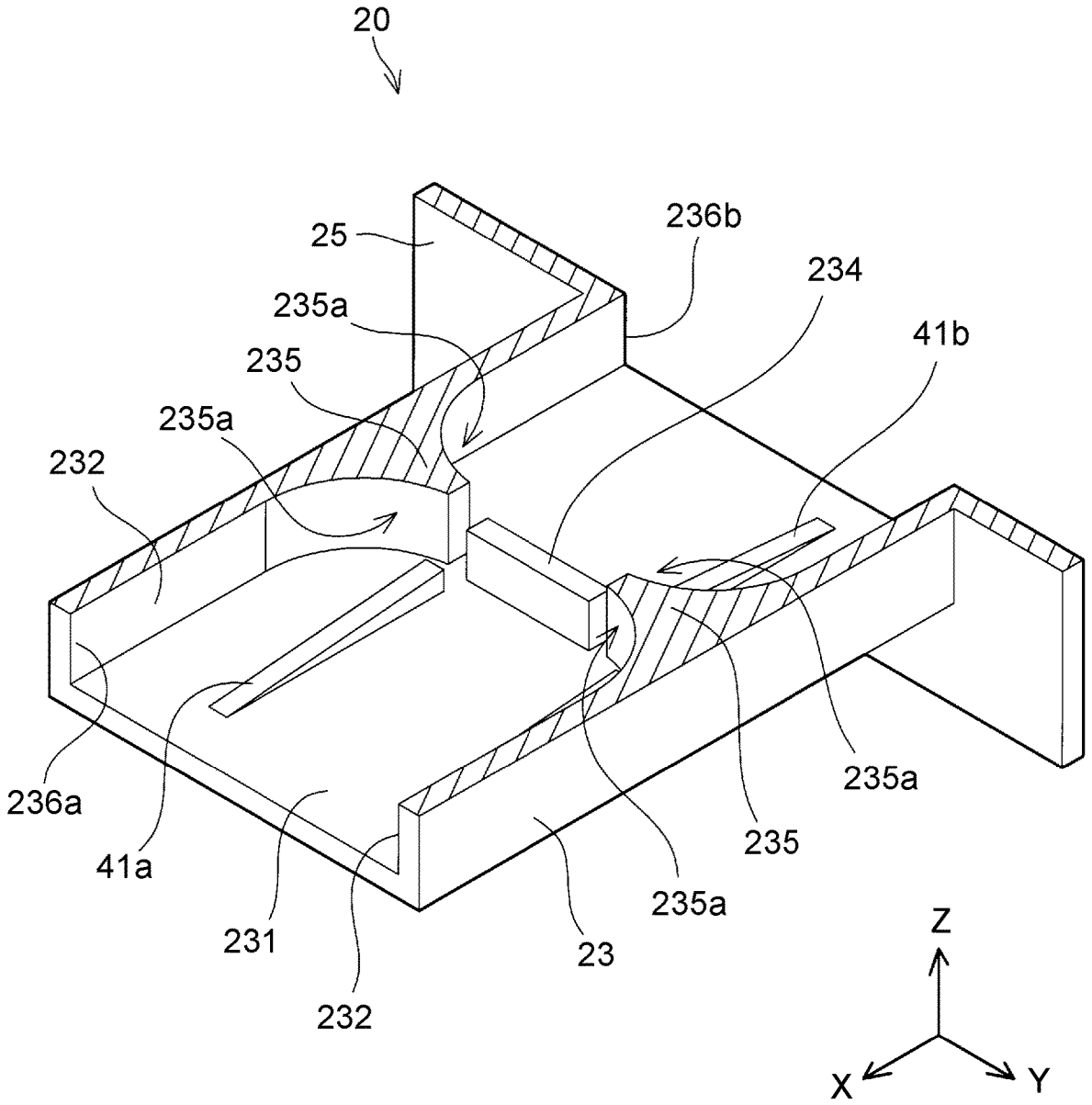
FIG. 4 is a perspective sectional view of the bobbin taken along an alternate long and short dash line IV in FIG. 3.

FIG. 4 is a perspective view of the bobbin 20 taken along an alternate long and short dash line IV in FIG. 3. A wall 234 is provided at the center of the bottom surface 231 of the tubular portion 23 in the axial direction (X-direction). A wall 234 having the same shape as that provided on the bottom surface 231 is provided at the center of the upper surface 233. A projection 235 is provided at the center of each lateral surface 232 in the axial direction. At the center of the tubular portion 23 in the axial direction, the inner cross-sectional area of the tubular portion 23 is reduced by the walls 234 and the projections 235. The spacer 31 illustrated in FIG. 2 is fitted in the space defined by the walls 234 and the projections 235.

Each lateral surface 232 is curved so as to approach the other lateral surface 232 as the lateral surface 232 extends toward the center of tubular portion 23 in the axial direction. Thus, each lateral surface 232 has curved surfaces 235*a*. The curved surfaces 235*a* face the curved surfaces 301 at the boundaries between the lateral surfaces and the distal end surfaces 305 of the core parts 30*a*, 30*b*.

As described above, the projection 41*a* extending in the axial direction is provided on the bottom surface 231. The projection 41*a* extends to a position near the center of the tubular portion 23 in the axial direction. The height of the projection 41*a* decreases in the direction toward the opening 236*a*. A projection 41*b* is provided on the bottom surface 231, on an opening 236*b*-side of the tubular portion 23. The projection 41*b* extends in the axial direction (X-direction). The height of the projection 41*b* decreases in a direction toward the opening 236*b*. Although not illustrated in FIG. 4, the upper surface 233 is provided with projections 41*a*, 41*b* having the same shapes as those provided on the bottom surface 231. The projections 41*a*, 41*b* provided on the upper surface 233 respectively face the projections 41*a*, 41*b* provided on the bottom surface 231.

Figure 5:
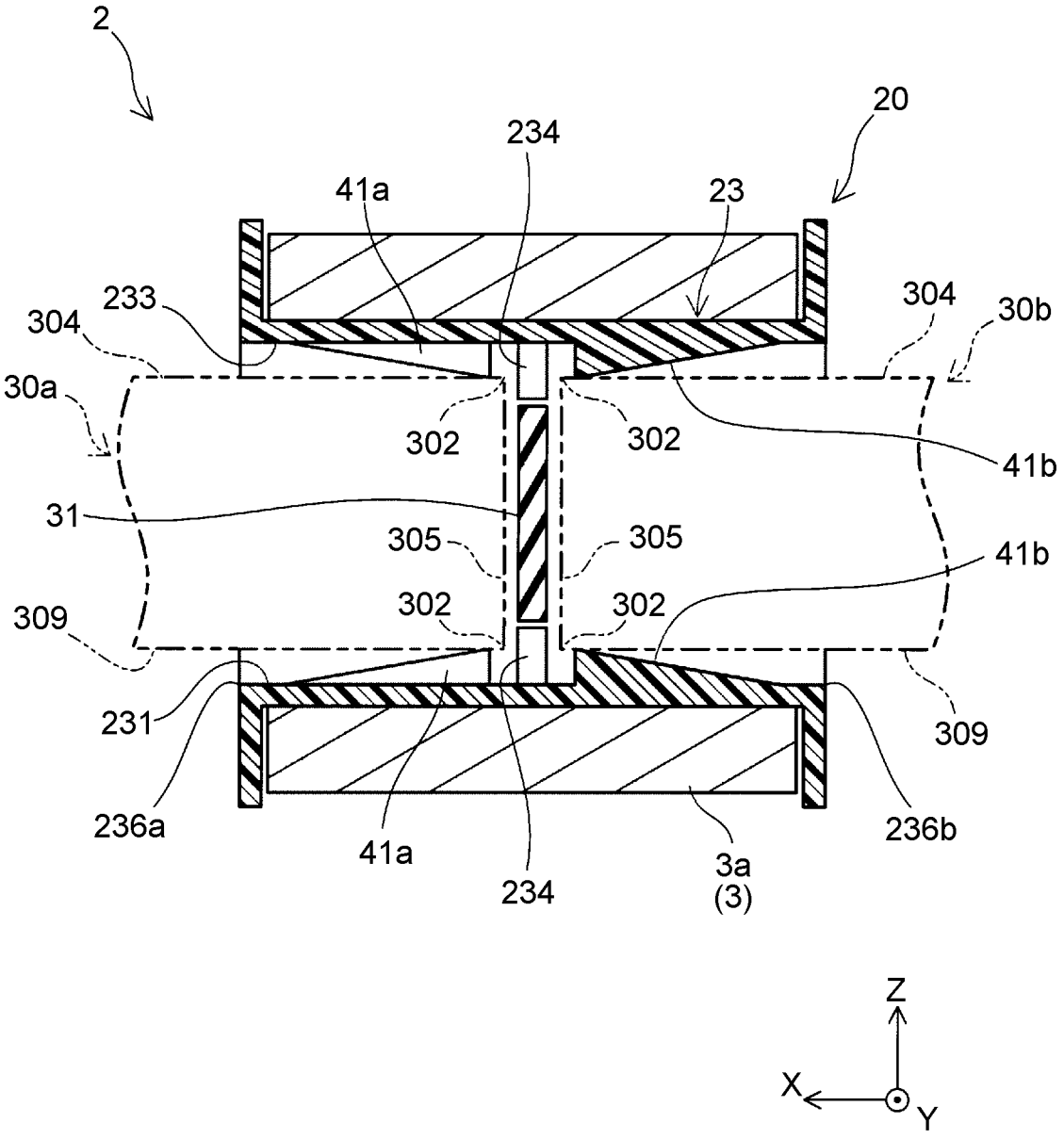
FIG. 5 is a sectional view of the reactor taken along an alternate long and short dash line V-V line in FIG. 1.

FIG. 5 is a sectional view taken along an alternate long and short dash line V-V line in FIG. 1. The section illustrated in FIG. 5 is a section passing through the projections 41*b* (see FIG. 4). In FIG. 5, the core parts 30*a*, 30*b* are indicated by imaginary lines.

As described above, the spacer 31 is interposed between the wall 234 provided on the bottom surface 231 and the wall 234 provided on the upper surface 233. The bottom surface 231 and the upper surface 233, which face each other, are respectively provided with the projections 41*a*. The core part 30*a* is interposed between the projections 41*a*. The projections 41*a* are in contact with the core part 30*a*. As described above, the core part 30*a* is configured such that the upper side surface 304 is perpendicular to the distal end surfaces 305, and the edges 302 are formed at the boundaries between the upper side surface 304 and the distal end surfaces 305. Similarly, the core part 30*a* is configured such that the lower side surface 309 is perpendicular to the distal end surfaces 305, and the edges 302 are formed between the lower side surface 309 and the distal end surfaces 305. If the edge 302 comes into contact with the inner surface of the tubular portion 23 in the course of inserting the core part 30*a* into the tubular portions 23 from the opening 236*a*-side, the edge 302 may be chipped. The core part 30*a* is made of a magnetic green-compact formed by mixing magnetic particles with resin and subjecting the mixture to compression-sintering. Thus, the edges 302 may be especially easily chipped. The tubular portion 23 is configured such that the bottom surface 231 and the upper surface 233, which are the inner surfaces facing each other, are respectively provided with the projections 41*a* extending in the axial direction of the tubular portion 23. The core part 30*a* is in contact with both of the two projections 41*a*. The core part 30*a* is out of contact with the tubular portion 23 except the projections 41*a*. In the course of inserting the core part 30*a* into the opening 236*a*, the upper side surface 304 and the lower side surface 309 of the core part 30*a* are guided by the projections 41*a*. This prevents the edges 302 from coming into contact with the tubular portion 23, thereby preventing the edges 302 from being chipped.

Similarly, the projections 41*b* for the core part 30*b* are respectively provided on the upper surface 233 and the bottom surface 231 of the tubular portion 23. The projections 41*b* also extend in the axial direction of the tubular portion 23, and the height of each projection 41*b* decreases in the direction toward the opening 236*b*. Both of the two projections 41*b* are in contact with the core part 30*b*. The core part 30*b* is out of contact with the tubular portion 23 except the projections 41*b*. In the course of inserting the core part 30*b* into the opening 236*b*, the upper side surface 304 and the lower side surface 309 of the core part 30*b* are guided by the projections 41*b*. This prevents the edges 302 at the boundaries between the distal end surface 305 and the upper and lower side surface 304, 309 from coming into contact with the inner surfaces of the tubular portion 23, thereby preventing the edges 302 from being chipped.

The height of each projection 41*a* decreases in the direction toward the opening 236*a*. In the vicinity of the opening 236*a*, a clearance is left between the core part 30*a* and each projection 41*a*. Thus, the core part 30*a* can be easily inserted into the tubular portion 23. As the core part 30*a* is moved deeper into the tubular portion 23, the clearance between the core part 30*a* and each projection 41*a* decreases, and the core part 30*a* finally comes into contact with the projections 41*a*. Because the height of each projection 41*a* decreases in the direction toward the opening 236*a*, the core part 30*a* is smoothly guided by the projections 41*a*. Thus, the edges 302 of the core part 30*a* are less likely to be chipped even if the core part 30*a* comes into contact with the projections 41*a*. The relationship between the projections 41*b* and the core part 30*b* is the same as that between the projections 41*a* and the core part 30*a*. Thus, the edges 302 of the core part 30*b* are also less likely to be chipped.

Figure 6:
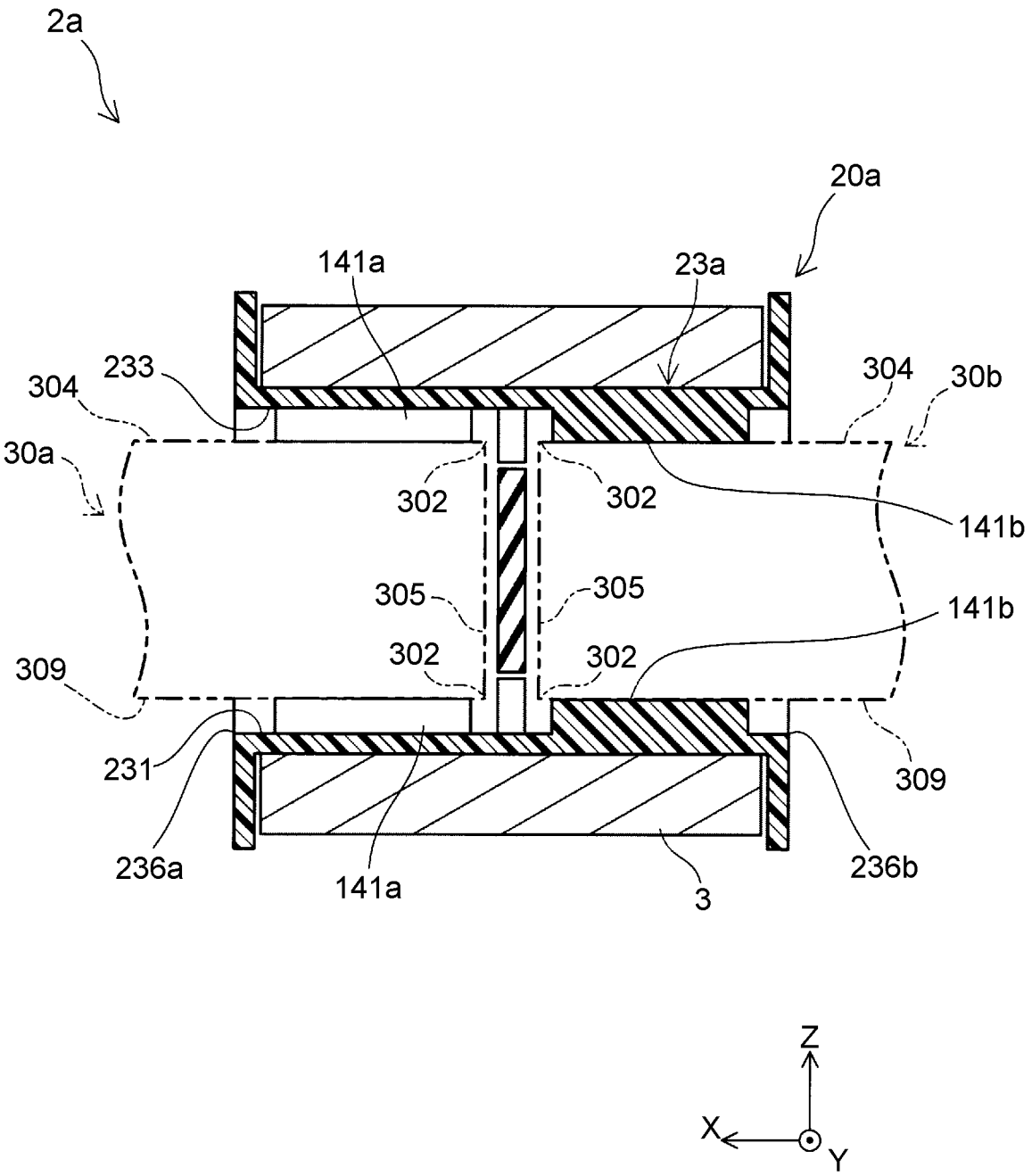
FIG. 6 is a sectional view of a reactor in a first modified example.

FIG. 6 is a sectional view of a reactor 2*a* in a first modified example. The sectional view in FIG. 6 corresponds to the sectional view in FIG. 5. In the reactor 2*a*, projections 141*a* are respectively provided on the bottom surface 231 and the upper surface 233 of a tubular portion 23*a* of a bobbin 20*a*, and projections 141*b* are respectively provided on the bottom surface 231 and the upper surface 233. The bottom surface 231 and the upper surface 233 face each other. The projections 141*a*, 141*b* extend in the axial direction (X-direction in the drawing) of the tubular portion 23*a*. The core part 30*a* is interposed between the two projections 141*a*, and the core part 30*b* is interposed between the two projections 141*b*.

In the reactor 2 according to the foregoing embodiment, the height of each projection 41*a* decreases in the direction toward the opening 236*a* of the tubular portion 23, and the height of each projection 41*b* decreases in the direction toward the opening 236*b* of the tubular portion 23. In contrast to this, in the reactor 2*a* in the first modified example, the height of each of the projections 141*a*, 141*b* remains constant. Preferably, the height of each projection decreases toward the opening, like the projections 41*a*, 41*b* of the reactor 2 according to the foregoing embodiment. However, even the reactor 2*a* in the first modified example can produce an advantageous effect of making it difficult for the edges 302 of the core parts 30*a*, 30*b* to be chipped.

Figure 7:
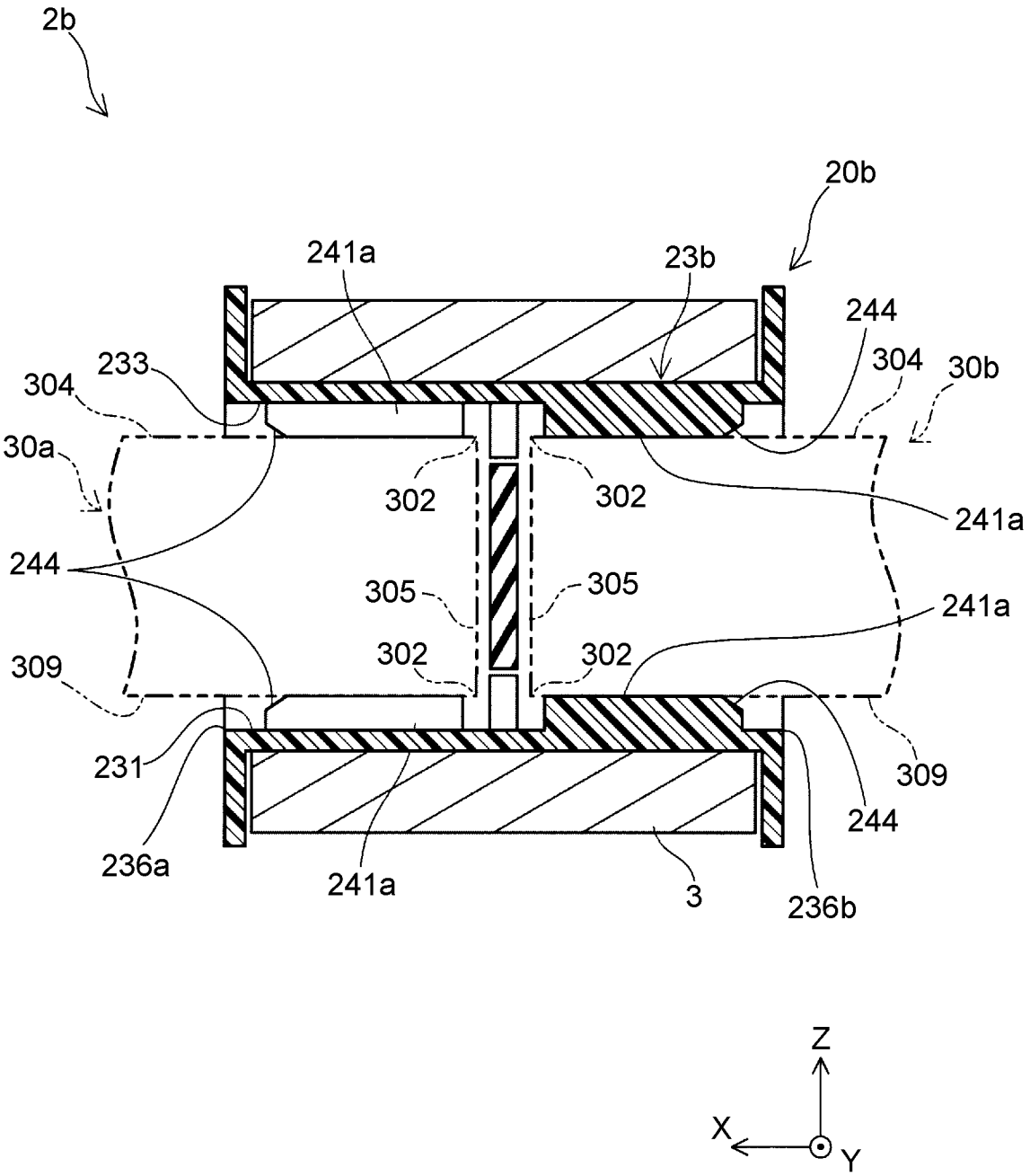
FIG. 7 is a sectional view of a reactor in a second modified example.

FIG. 7 is a sectional view of a reactor 2*b* in a second modified example. The sectional view in FIG. 7 corresponds to the sectional view in FIG. 5. In the reactor 2*b*, projections 241*a* are respectively provided on the bottom surface 231 and the upper surface 233 of a tubular portion 23*b* of a bobbin 20*b*, and projections 241*b* are respectively provided on the bottom surface 231 and the upper surface 233. The bottom surface 231 and the upper surface 233 face each other. The projections 241*a*, 241*b* extend in the axial direction (X-direction in the drawing) of the tubular portion 23*a*. The core part 30*a* is interposed between the two projections 241*a*, and the core part 30*b* is interposed between the two projections 241*b*.

In the reactor 2*b* in the second modified example, the height of each of the projections 241*a*, 241*b* remains constant over almost the entire length thereof. However, an end of each projection 241*a*, which is close to the opening 236*a*, is chamfered, so that a tilted surface 244 is provided. Similarly, an end of each projection 241*b*, which is close to the opening 236*b*, is chamfered, so that a tilted surface 244 is provided. In each projection 241*a*, the tilted surface 244 of which the height decreases in the direction toward the opening 236*a* is provided at the end located close to the opening 236*a*. Similarly, in each projection 241*b*, the tilted surface 244 of which the height decreases in the direction toward the opening 236*b* is provided at the end located close to the opening 236*b*. The reactor 2*a* in the second modified example can produce an advantageous effect of making it difficult for the edges 302 of the core parts 30*a*, 30*b* to be chipped.

Figure 8:
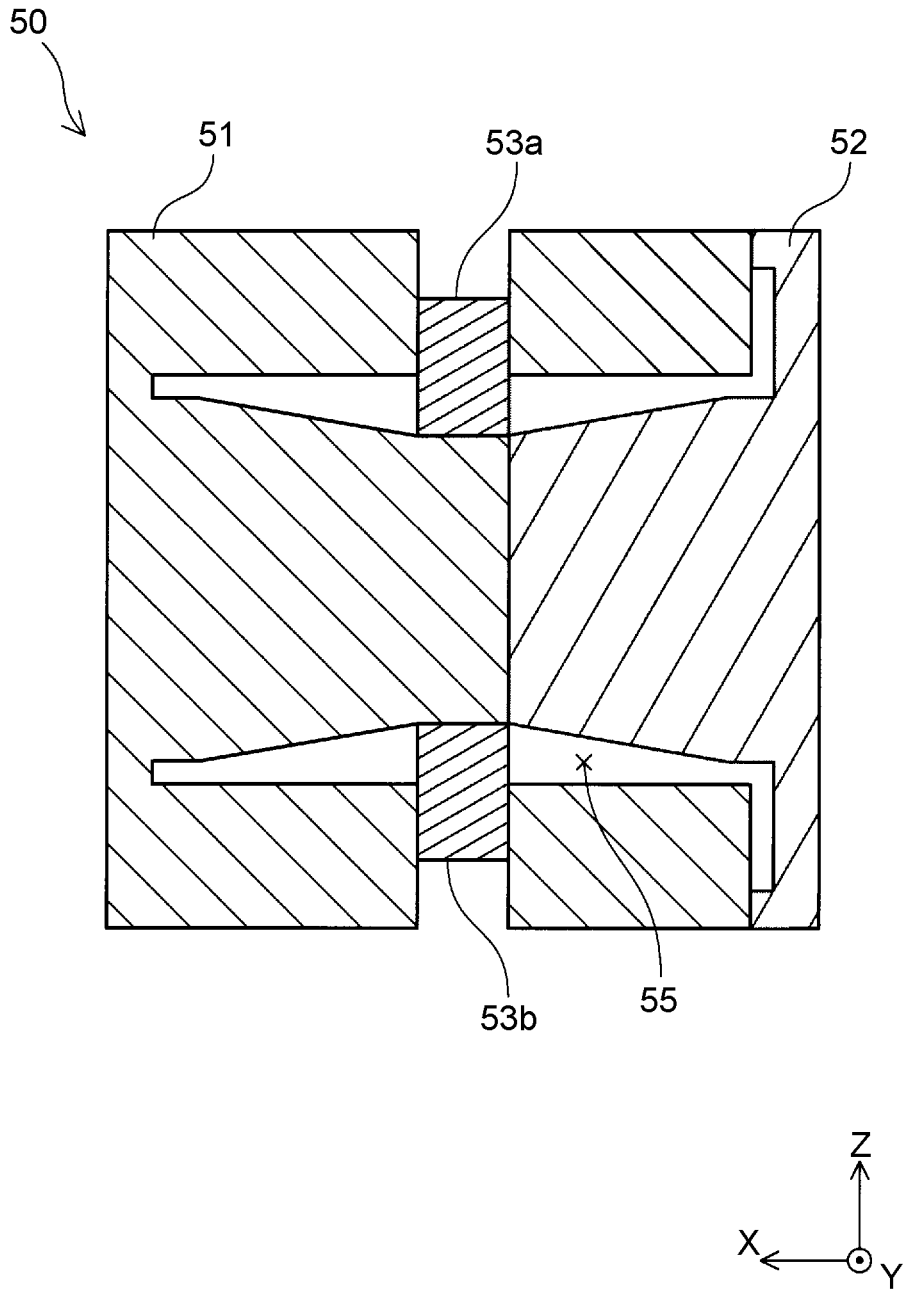
FIG. 8 is a sectional view of a mold for forming a bobbin in a third modified example.
Figure 9:
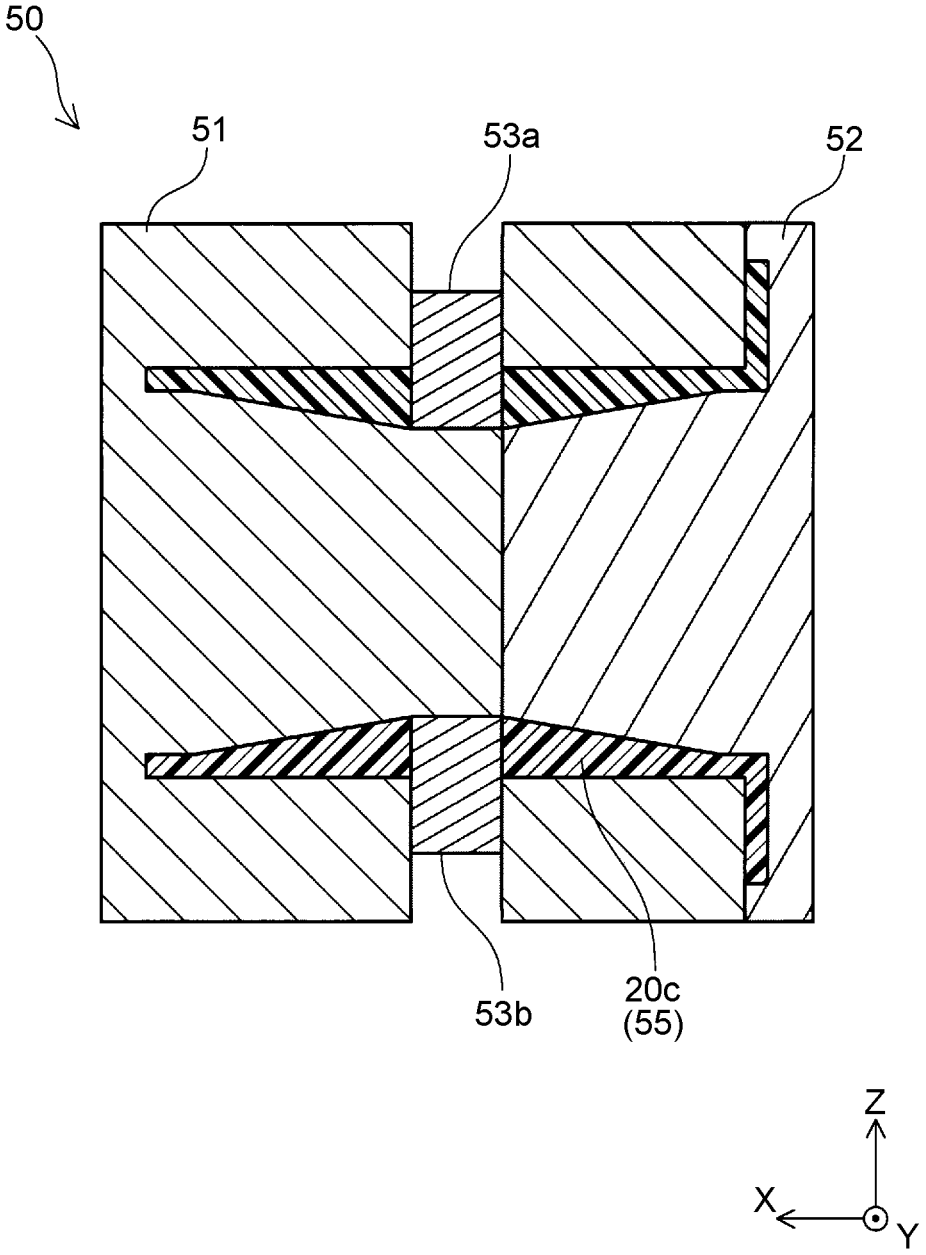
FIG. 9 is a sectional view of the mold for forming the bobbin in the third modified example (after injection molding)
Figure 10:
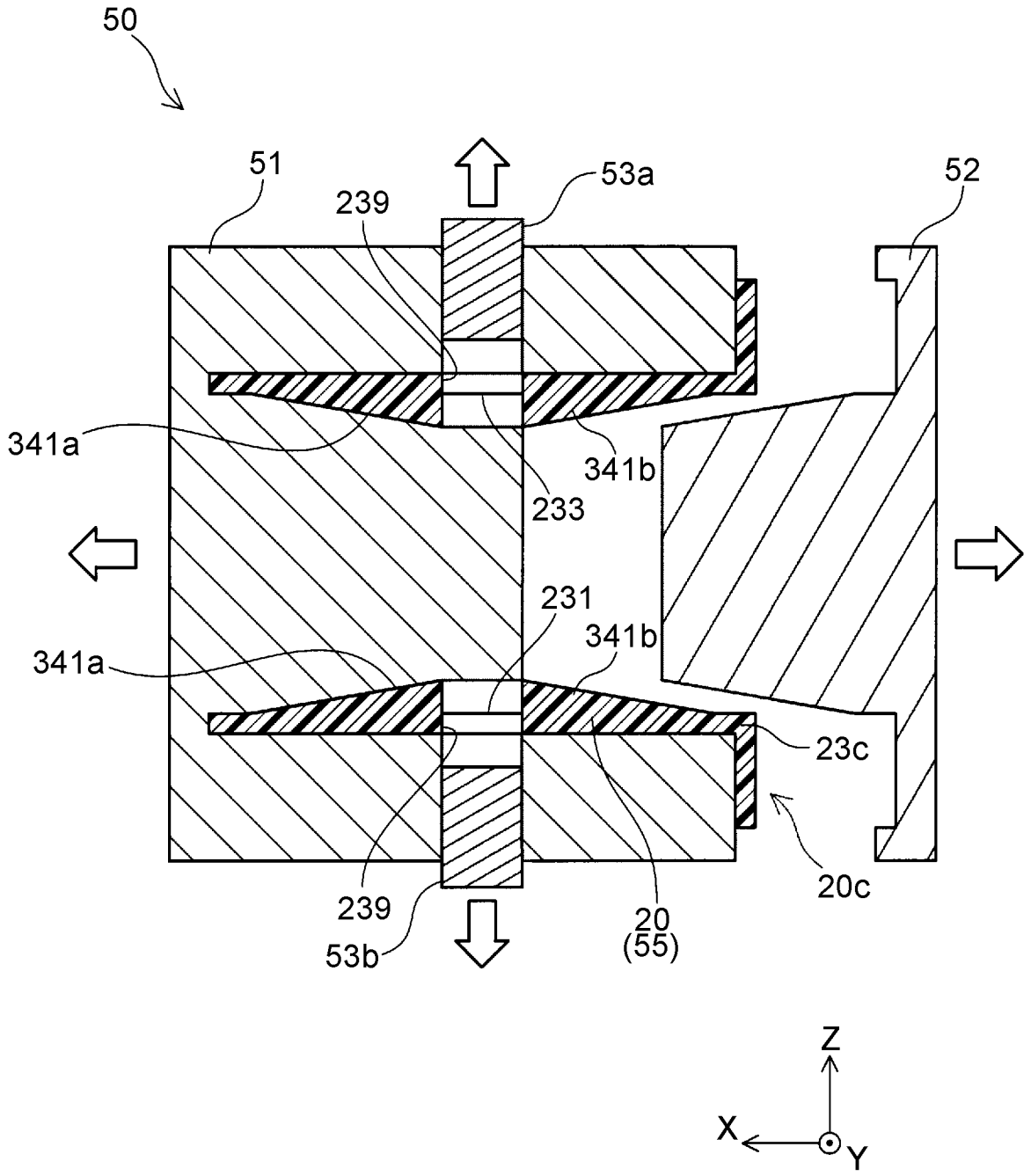
FIG. 10 is a sectional view of the mold in an opened state.

With reference to FIG. 8 to FIG. 10, a bobbin 20*c* in a third modified example and a method of manufacturing the bobbin 20*c* will be described. FIG. 8 is a sectional view of a mold 50 for forming the bobbin 20*c* through injection-molding. FIG. 9 is a sectional view of the bobbin 20*c* formed, through injection-molding, in a cavity 55 of the mold 50. FIG. 10 is a sectional view of the mold 50 in an opened state and the bobbin 20*c*. Each of FIG. 8 to FIG. 10 illustrates the bobbin 20*c* that has not been provided with a flange to be disposed on the left side in the drawings. As described above, the left flange (the flange 21 in FIG. 2) will be attached to the bobbin 20*c* in a subsequent step.

As illustrated in FIG. 4, in the bobbin 20 according to the foregoing embodiment, the projection 41*a* provided on the opening 236*a*-side and the projection 41*b* provided on the opening 236*b*-side are not aligned with each other in the axial direction (X-direction) of the tubular portion 23. As illustrated in FIG. 10, in the bobbin 20*c* in the third embodiment, the projection 341*a* provided on the left opening-side in the drawing and the protrusion 341*b* provided on the right opening-side in the drawing are aligned with each other. In this case, portions of the bobbin 20*c* between the projections 341*a* and the projections 341*b* serve as undercuts for the mold 50 for forming a space in a tubular portion. The mold 50 is configured to prevent formation of undercuts between the projections 341*a* and the projections 341*b*.

FIG. 8 is a sectional view of the mold 50. The mold 50 includes a left mold 51 and a right mold 52. The left mold 51 includes slide molds 53*a*, 53*b* configured to prevent formation of undercuts in the bobbin 20*c*. The cavity 55 of the mold 50 is in the form of the bobbin 20*c*.

As illustrated in FIG. 9, molten resin is injected into the cavity 55 to form the bobbin 20*c*. After the molten resin is hardened, the slide mold 53*a* is moved upward, and the slide mold 53*b* is moved downward (FIG. 10). The slide molds 53*a*, 53*b* extend through the tubular portion 23*c* of the bobbin 20*c*, and regions from which the slide molds 53*a*, 53*b* have been removed become through-holes 239 in an upper side surface and a lower side surface of the tubular portion 23*c*. In the bobbin 20*c* as a product, the upper and lower side surfaces of the bobbin 20*c* are provided with the through-holes 239, and the through-holes 239 are provided adjacent to the ends of the projections 341*a*, 341*b*, which are located close to the center of the bobbin 20*c* in the axial direction (X-direction) of the bobbin 20*c*.

As described above, the bobbin 20*c* is made of resin and formed through injection-molding. When the bobbin is provided with the projections for two core parts to be inserted into the bobbin from the respective sides of the bobbin, the portions of the bobbin between projections may serve as undercuts for a mold for forming the bobbin through injection-molding (the bobbin 20*c*). The through-holes 239 provided adjacent to the ends of the projections 341*a*, 341*b*, which are located close to the center of the bobbin 20*c* in the axial direction of the bobbin 20*c*, are regions into which the slide molds 53*a*, 53*b* for preventing formation of undercuts are to be inserted.

A general outline of the technique described in the foregoing embodiment will be described. The reactor according to the foregoing embodiment includes the core having a ring shape, and the tubular portions of the bobbin and the coils are attached to two portions of the core. The technique described in the present specification may also be applied to a reactor including a core in a simple quadrangular prism shape, a bobbin including a single tubular portion, and a single coil.

Concrete examples of the disclosure have been described in detail; however, they are merely examples and do not limit the scope of the claims. The technique described in the claims encompasses various modification and alterations made to the foregoing concrete examples. The technical elements described in the present specification and the drawings exert technical values alone or in various combinations, and are not limited to the combination described in the claims at the time of filing. The techniques exemplified in the present specification or the drawings can achieve multiple purposes simultaneously and are technically valuable by merely achieving one of the purposes.

What is claimed is:

1. A reactor comprising:

a bobbin around which a coil is wound, the bobbin having a tubular shape; and a core extending through the bobbin, wherein the core has a quadrangular prism shape, and the core includes a distal end surface and a pair of side surfaces perpendicular to the distal end surface, the side surfaces being opposite surfaces of the core, and the bobbin has inner surfaces each of which has a pair of projections, the inner surfaces of the bobbin respectively facing the side surfaces of the core, the projections extending in an axial direction of a tubular portion of the bobbin, and the projections being in contact with the core, wherein for each of the inner surfaces: one projection of the pair of projections extends from one opening of the tubular portion to a position near a center of the tubular portion in the axial direction, another projection of the pair of projections extends from another opening of the tubular portion to a position near the center of the tubular portion in the axial direction, and the pair of projections are spaced apart from each other in the axial direction and not aligned with each other in the axial direction.

2. The reactor according to claim 1, wherein a height of each of the projections decreases in a direction toward the corresponding opening of the tubular portion.

3. The reactor according to claim 2, wherein:

the core includes at least two core parts that are a first core part and a second core part;

a distal end of the first core part and a distal end of the second core part face each other inside the bobbin; and the bobbin includes the projections for each of the first core part and the second core part.

4. The reactor according to claim 1, wherein:

the core includes at least two core parts that are a first core part and a second core part;

a distal end of the first core part and a distal end of the second core part face each other inside the bobbin; and the bobbin includes the projections for each of the first core part and the second core part.

* * * * *